US006568050B2

(12) United States Patent
Duval

(10) Patent No.: US 6,568,050 B2
(45) Date of Patent: May 27, 2003

(54) METHOD AND INSTALLATION FOR ADVANCING A NEEDLED FIBER PLATE

(75) Inventor: Renaud Duval, Les Cheres (FR)

(73) Assignee: Messier-Bugatti, Velizy Villacoublay (FR)

( * ) Notice: Subject to any disclaimer, the term of this patent is extended or adjusted under 35 U.S.C. 154(b) by 0 days.

(21) Appl. No.: 10/153,475

(22) Filed: May 22, 2002

(65) Prior Publication Data

US 2002/0133923 A1 Sep. 26, 2002

Related U.S. Application Data

(63) Continuation-in-part of application No. 09/899,517, filed on Jul. 5, 2001, now abandoned, and a continuation of application No. PCT/FR02/00694, filed on Feb. 26, 2002.

(30) Foreign Application Priority Data

Feb. 26, 2001 (FR) ..... 01 02555

(51) Int. Cl.[7] ..... D04H 18/00
(52) U.S. Cl. ..... 28/107
(58) Field of Search ..... 28/107, 114, 110, 28/109, 111, 113, 115, 103, 108; 156/148; 112/80.23, 80.18, 470.01, 470.03, 275

(56) References Cited

U.S. PATENT DOCUMENTS

| | | | | |
|---|---|---|---|---|
| 3,391,436 A | | 7/1968 | Fchrer | 28/107 |
| 4,790,052 A | | 12/1988 | Olry | 28/110 |
| 4,891,870 A | | 1/1990 | Muller | 28/107 |
| 5,031,289 A | | 7/1991 | LeRoy et al. | 28/107 |
| 5,792,715 A | | 8/1998 | Duval et al. | 28/107 |
| 5,813,101 A | | 9/1998 | Fehrer | 28/107 |
| 5,822,834 A | | 10/1998 | Jourde et al. | 28/107 |
| 5,896,633 A | | 4/1999 | Fehrer | 28/103 |
| 5,909,883 A | | 6/1999 | Jourde et al. | 28/114 |
| 6,000,112 A | | 12/1999 | Ollinger et al. | 28/107 |
| 6,029,327 A | | 2/2000 | Sheehan et al. | 156/148 |
| 6,105,223 A | | 8/2000 | Brown et al. | 28/107 |
| 6,293,210 B1 | * | 9/2001 | Freeman et al. | 112/80.01 |
| 6,360,412 B1 | * | 3/2002 | Duval et al. | 28/107 |
| 6,374,469 B1 | * | 4/2002 | Baudry et al. | 28/107 |
| 6,381,818 B1 | * | 5/2002 | Freeman et al. | 28/107 |

FOREIGN PATENT DOCUMENTS

| | | |
|---|---|---|
| EP | 0 695 823 A2 | 2/1996 |
| FR | 2 621 333 | 4/1989 |
| FR | 2 729 404 | 7/1996 |
| FR | 2 745 012 | 8/1997 |
| GB | 2 310 221 A | 8/1997 |
| JP | 3193921 | 8/1991 |
| WO | WO 97/15708 | 5/1997 |

* cited by examiner

*Primary Examiner*—Amy B. Vanatta
(74) *Attorney, Agent, or Firm*—Weingarten, Schurgin, Gagnebin & Lebovici LLP

(57) ABSTRACT

A fiber structure for needling is driven so as to impart a speed of advance thereto past a needling head carrying a plurality of needles that are driven with reciprocating motion during which they penetrate into the fiber structure and are extracted therefrom. The instantaneous speed of advance of the fiber structure decreases in response to the resistance to advance caused by the needles penetrating and subsequently increases on the needles being withdrawn. The force exerted on the needles by the advance of the structure is thus limited, without completely interrupting advance throughout the time that needles are present within the structure. The fiber structure can be caused to advance by means of a transmission presenting mechanical slack suitable for absorbing the decrease in the speed of advance caused directly by the resistance to advance that is exerted by the needles.

15 Claims, 5 Drawing Sheets

METHOD AND INSTALLATION FOR ADVANCING A NEEDLED FIBER PLATE

RELATED APPLICATION

This application is a continuation-in-part of U.S. patent application Ser. No 09/899,517 filed on Jul. 5, 2001 now abandoned and a continuation of PCT/FR02/00694, filed on Feb. 26, 2002.

BACKGROUND OF THE INVENTION

The invention relates to needling fiber structures. A particular but non-exclusive field of the invention is making plates, sleeves, or other needled preforms, e.g. of annular shape, suitable for constituting the reinforcement of composite material parts.

In well-known manner, a fiber structure for needling is advanced past a set of needles carried by a needling head, and the needles are periodically inserted into the fiber structure and then withdrawn therefrom, by imparting go-and-return motion to the needling head in a direction that extends transversely relative to the structure advance direction.

Reference can be made in particular to U.S. Pat. No. 4,790,052 which describes making needled fiber structures by successively needling layers formed by plies superposed flat or by turns wound one on another. The intended field of that patent is making fiber reinforcement for thermostructural composite material parts, and in particular carbon—carbon composite material parts or ceramic matrix composite material parts in which the fiber reinforcement is densified by means of a carbon or a ceramic matrix. Needled fiber structures are made of refractory fibers, typically carbon fibers or ceramic fibers, with it being possible to perform needling on the fibers while the fiber material is in a precursor state for carbon or ceramic, and after needling the precursor is transformed by heat treatment. The intended applications of the above-cited patent are brake disks or the diverging portions of rocket engines, which applications require materials that have good mechanical properties and the ability to conserve them at high temperatures.

Needling superposed layers of fibers serves to transfer fibers in the Z direction, i.e. transversely relative to the layers. This produces a structure which presents less non-uniformity and increased ability to withstand delamination, i.e. increased resistance to the layers separating due to shear forces to which they can be subjected, particularly in brake disks.

In order to perform needling over the entire surface area of a fiber structure, the structure is advanced past a needling head. When needling is performed on each new superposed layer, an advance movement is performed each time a new layer is put into place so that the needling head sweeps over the entire surface area of the most recently superposed layer.

If the fiber structure is caused to advance continuously at constant speed, then it moves transversely relative to the needles throughout the duration of needle penetration. In particular, when the structure is thick or once it has become thick, the forced advance causes the needles to bend and they can break. In addition to the fact that broken needles need to be replaced, the presence of broken needles within the fiber structure can be undesirable in subsequent use of that structure.

It might be envisaged to ensure that the structure advances very slowly, thereby minimizing the bending forces applied to the needles while they are present within the fiber structure, or else to advance the structure discontinuously so that it is stationary during needle penetration.

However those solutions present the clear drawback of considerably increasing the time and thus also the cost required for the process of fully needling the structure.

Another process for controlling advance in a needling machine is disclosed in U.S. Pat. No. 5,909,883, in which the rotational speed of calling rollers for the needled fiber structure is modulated, so that the rotational speed has different values for different positions of the needles. It is then necessary to provide a system allowing the rollers to be driven at a variable speed. Also, the variation in speed does not take into account the actual instantaneous forces applied to the needles.

OBJECT AND SUMMARY OF THE INVENTION

The object of the invention is to propose a method of needling a fiber structure which makes it possible to resolve the problem of needles breaking without significantly penalizing the speed of the method, even with structures that are thick.

According to the invention, the instantaneous speed of advance of the fiber structure decreases in response to the resistance to advance exerted by the needles penetrating into the structure, and increases after the needles have been withdrawn, so that the force exerted on the needles by the advance of the structure is limited, but without completely interrupting advance throughout the entire duration of needles being present in the structure.

In a preferred implementation, the decrease in the speed of advance is caused directly by the resistance to advance exerted by the needles on penetrating into the structure.

When the structure is moved by means of a controlled member connected to a drive motor by a transmission, the decrease in the speed of advance can be absorbed by mechanical slack in the transmission. In which case, since the motor is driven at constant speed, the slack which is preferably resilient is automatically taken up once the needles have been withdrawn.

Thus, while the needles are penetrating, the speed of advance of the structure decreases to below a mean speed of advance corresponding to the speed of the motor, and once the needles have been withdrawn, this speed increases to above the mean speed of advance.

A measure of the torque at the level of a driving element engaged with the fiber structure may be carried out, in order to decrease the speed of the motor when the torque becomes smaller than a given threshold, as a consequence of the slowing down of the fiber structure.

In another implementation of the method, a value representative of the force exerted to drive the fiber structure is measured, the driving speed of the fiber structure is reduced when the measured value becomes equal to or larger than a first threshold value, and, after the speed has been reduced, the driving speed is increased when the measured value becomes lower than a second threshold value.

The second threshold value may be equal to or lower than the first one.

The measured value is for example representative of the torque exerted by a driving element for the fiber structure.

Another object of the invention is to provide an installation enabling the method to be implemented.

This object is achieved by means of an installation for needling a fiber structure, the installation comprising a needling head carrying a plurality of needles, a device for driving the needling head to impart reciprocating motion to the needles, a support for the fiber structure to be needled situated facing the needling head, and a device for driving the fiber structure so as to impart an advance movement thereto on said support, in which installation, according to the invention, the fiber structure drive device is designed to enable the speed of advance of the fiber structure carried by the support to decrease momentarily in response to the resistance to advance exerted by the needles penetrating into the fiber structure, without completely interrupting advance throughout the duration of the needles being present in the fiber structure.

BRIEF DESCRIPTION OF THE DRAWINGS

The invention will be better understood on reading the following description given by way of non-limiting indication and with reference to the accompanying drawings, in which.

DETAILED DESCRIPTION OF IMPLEMENTATIONS OF THE INVENTION

Figure 1:
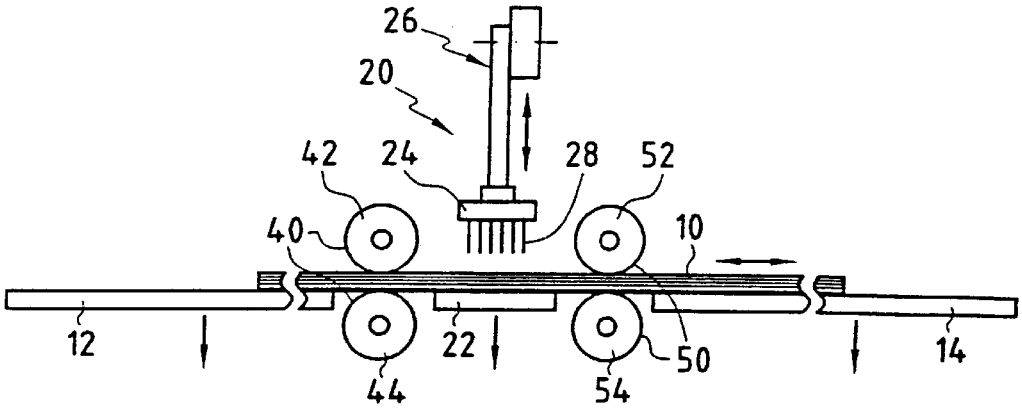
FIG. 1 is a highly diagrammatic front view of a needling installation.
Figure 2:
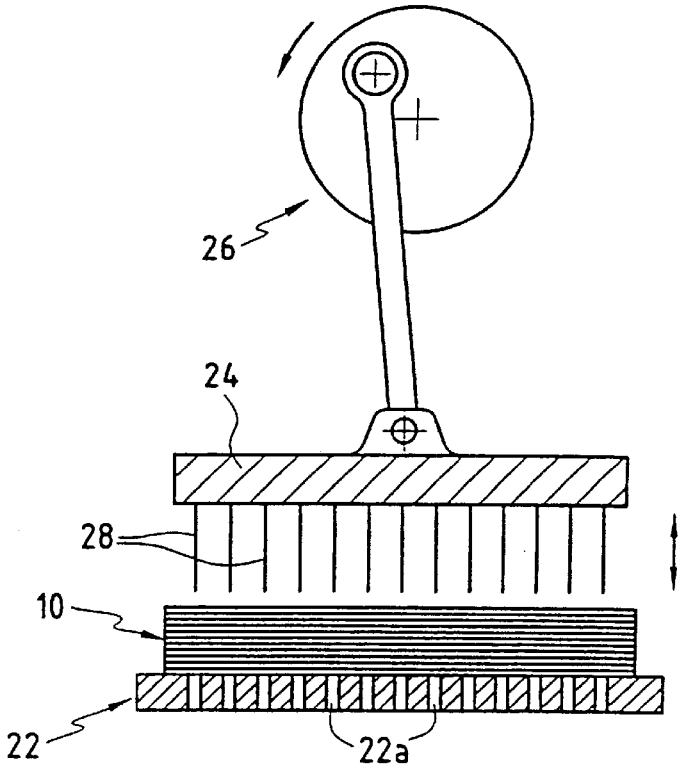
FIG. 2 is a highly diagrammatic fragmentary view on a larger scale of the FIG. 1 installation in lateral elevation and in section.

FIGS. 1 and 2 show an installation for needling a plate-shaped fiber structure 10.

The structure 10 is built up from two-dimensional plies stacked up flat and needled to one another so as to bind the plies together and give the plate resistance to delamination.

By way of example, the individual plies are strips of woven cloth or other two-dimensional fabric, for example a fabric made up of one-dimensional sheets superposed in different directions and bonded together by light needling.

By way of example, the plies are needled individually, with a needling pass being performed over the entire surface area of the fiber plate after each new ply has been superposed thereon. Nevertheless, the ambit of the present invention extends to performing a needling pass after superposing two or more plies thereon, and even to performing two or more needling passes after each ply making up the plate has been superposed thereon.

The plate 10 being needled is moved horizontally through a needling station 20 between a first support table 12 and a second support table 14 situated on either side of the needling station. The plate is moved alternately in one direction and then in the opposite direction from the table 12 to the table 14, and back again.

In the needling station 20, the plate passes over a needling platen 22 situated beneath a needling head 24. A drive system 26 comprising at least one crank-and-connecting-rod assembly imparts vertical reciprocating motion to the needling head 24 under the control of a motor (not shown). The needling head 24 extends over the entire width of the plate 10 and carries a plurality of needles 28. Holes 22*a* are formed through the platen 22 in register with the needles 28.

The plate 10 is caused to advance by means of pairs of presser rollers 40, 50 situated between the needling platen 22 and each of the tables 12 and 14, respectively. In each pair 40 or 50 of presser rollers, the rollers 42 & 44 and 52 & 54 are driven in rotation, with at least one of the rollers in each pair being declutchable, e.g. the bottom roller 44, 54. When the plate 10 is moved from the table 12 towards the table 14, drive is provided by the rollers 52 and 54 pressed towards each other while the roller 44 is declutched, and possibly also the roller 42. Conversely, when the plate 10 is moved from the table 14 towards the table 12, then drive is performed by the rollers 42 and 44 pressed towards each other, while the roller 54 is declutched, and possibly also the roller 52.

When only one roller is declutched in a pair of non-driving rollers, it is also advantageous to eliminate the pressure exerted by the rollers so as to avoid any effect of drive from the non-declutched roller.

It will be noted that the lower rollers 44, 54 may be replaced by conveyor belts which may then constitute also tables 12 and 14.

After each needling pass, when the plate 10 has reached the table 12 or 14, a new ply is superposed and a new needling pass is performed by moving the plate 10 towards the other table 14 or 12. During each needling pass, the needles 28 penetrate vertically into the plate 10. The penetration depth of the needles 28 in the plate 10 is a function of the position of the needling head, at one of the ends of its vertical stroke, as measured relative to the needling platen 22.

The needle penetration depth can extend through several thicknesses of superposed plies. This depth can be adjusted depending on the distribution desired for needling density through the thickness of the plate. When a substantially uniform penetration depth is desired, then the distance between the needling platen 22 and the needling head is increased incrementally after each superposition of a new ply, by imparting a down step to the needling table. Reference can be made to above-cited document U.S. Pat. No. 4,790,052. A similar down step can be imparted to the tables 12 and 14 with the tables and the platen 22 all being mounted on a common vertically-movable frame. Thus, during needling of the first plies constituting the plate 10, the needles 28 pass through all of the plies and penetrate into the holes 22*a*. Once the plate 10 has been built up to a certain thickness, the needles 28 no longer reach the platen 22.

By means of the invention, the speed of advance of the plate 10 is slowed when the needles penetrate into the plate so as to limit the bending force applied to the needles due to plate advance and thus eliminate or at least minimize the risk of needles breaking.

For this purpose, in a preferred implementation of the invention, the slowdown is produced directly by penetration of the needles exerting a force that brakes the advance of the plate. This can be achieved by including mechanical slack in the transmission between a drive motor and the pairs of presser rollers.

Figure 3:
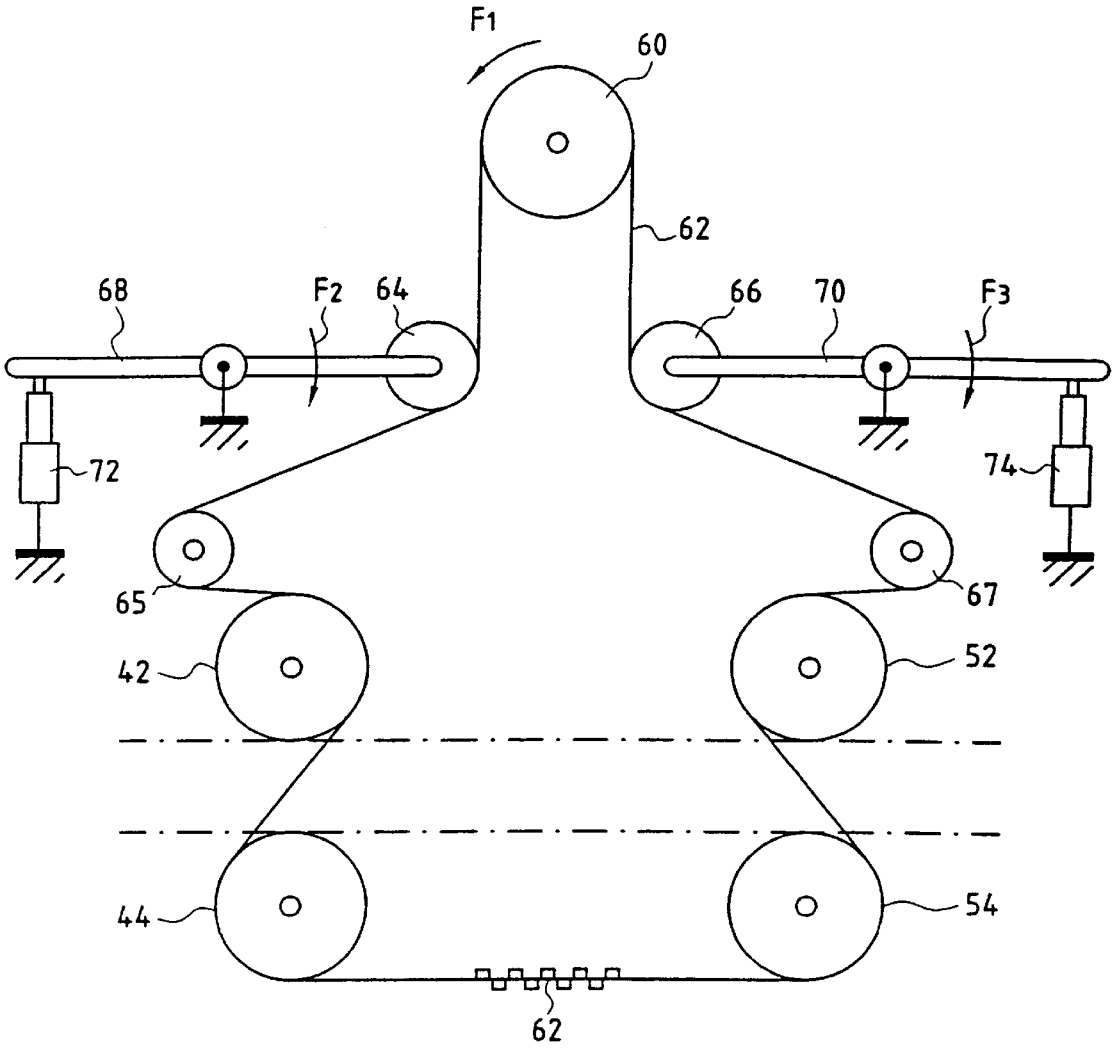
FIG. 3 is a highly diagrammatic view of a drive device making it possible, during needling, for a fiber structure to be advanced through an installation of the kind shown in FIGS. 1 and 2, for one embodiment of the invention.

FIG. 3 shows a device for driving the presser rollers and comprising a motor 60 turning at constant speed and driving a belt 62 passing over the presser rollers 42, 44 and 52, 54. On its path between the motor 60 and the top presser roller 42, the belt 62 passes over a tensioning roller 64 and a deflector roller 65, and on its path between the top presser roller 52 and the motor 60, the belt 62 passes over a deflector roller 67 and a tensioning roller 66.

In order to avoid relative slip between the belt 62 and the rollers over which it passes, it is preferable to use a double-sided cog belt meshing with corresponding relief formed on the surfaces of the rollers where they come into contact with the belt.

The tensioning rollers 64 and 66 are fixed at the ends of respective arms 68 and 70 forming hinged levers that are subjected to resilient return force exerted by respective devices 72 and 74 so as to keep the belt 62 permanently under tension. The devices 72 and 74 exerting resilient return force can be in the form of springs, or preferably in the form of pneumatic dampers. The pressure in the pneumatic dampers is advantageously adjustable.

Operation is as follows:

When the plate 10 is moved from the table 14 towards the table 12, the plate is driven by the presser rollers 42, 44 while at least the bottom roller 54 is declutched at the press 50. The motor 60 turns in the direction represented by arrow $F_1$. When the needles penetrate into the plate 10, the plate is slowed down by the needles, thereby reducing the speed of rotation of the rollers 42, 44. Because the belt 62 is driven at constant speed by the motor 60, the length of belt between the motor 60 and the roller 42 increases. This increase in length is absorbed by the tensioning roller 64 under the action of the resilient return force exerted by the damper 72 by pivoting the lever 68 in the direction indicated by arrow $F_2$. Conversely, the length of belt between the roller 52 and the motor 60 decreases, thereby causing the lever 70 to pivot in the direction indicated by arrow $F_3$ against the force exerted by the damper 74. When the needles subsequently come back out of the plate, the presser rollers 42, 44 accelerate and the length of belt that has accumulated between the motor 60 and the roller 42 is taken up until the two tensioning rollers 64 and 66 have returned to an equilibrium situation.

By adjusting the pressure in the dampers 72, 74 it is possible to adjust the return force they exert and to achieve synchronization and thus proper operation of the drive system.

When the plate 10 is moving from the table 12 towards the table 14, operation is symmetrical to that described above.

Figure 4:
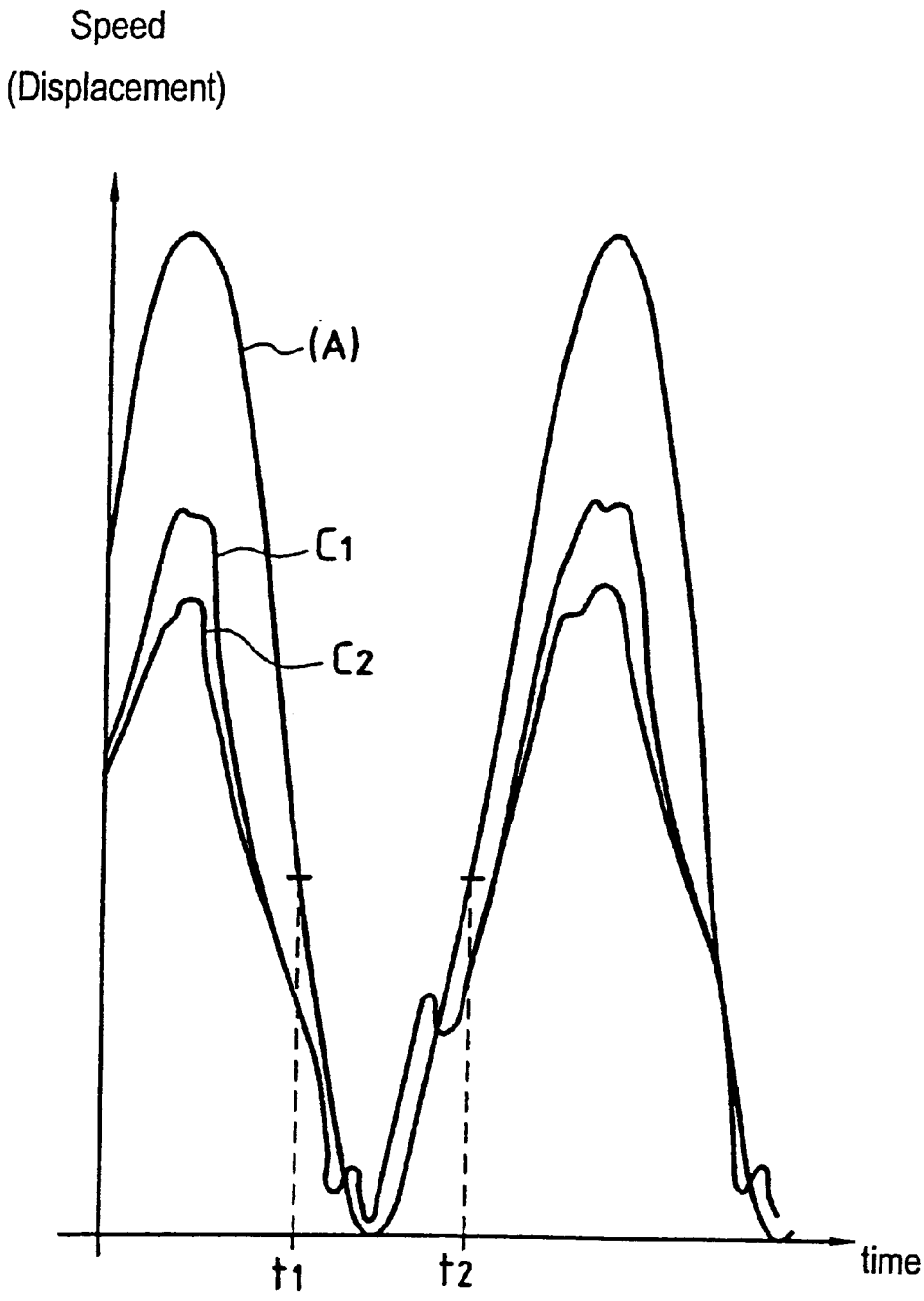
FIG. 4 is a graph showing how the advance speed of a fiber structure being needled varies as a function of time for the embodiment shown in FIG. 3.

FIG. 4 shows how the speed of advance of the plate 10 varies as a function of time while the plate is going from the table 12 towards the table 14, or vice versa, with curve $C_1$ representing the speed of the plate on entering the needling station and curve $C_2$ its speed on leaving it. Speed can be measured by means of a sensor carrying a follower wheel resting on the plate and rotated by the plate advancing. Curve A represents displacement of the needles between their high and low positions. The difference between the speeds of advance at the inlet and at the outlet are due to needling. Because fibers are transferred in the Z direction, the speed measured on the non-needled top layer upstream from the needling station is greater than the speed of the plate as measured after needling. Times $t_1$ and $t_2$ mark the beginning of needle penetration into the plate and full extraction of the needles from the plate. The time difference $\Delta t$ between times $t_1$ and $t_2$ depends on the penetration depth selected for the needles.

Because of the resilient slack present in the transmission between the motor 60 and the presses 40 and 50, the speed of advance of the plate 10 varies continuously between a maximum speed which is greater than the mean speed of advance corresponding to the speed of the motor, while the needles are not in the plate, and a minimum speed that is slower than said mean speed of advance, while the needles are in the plate, but advance is not interrupted during the time interval between $t_1$ and $t_2$.

Figure 5:
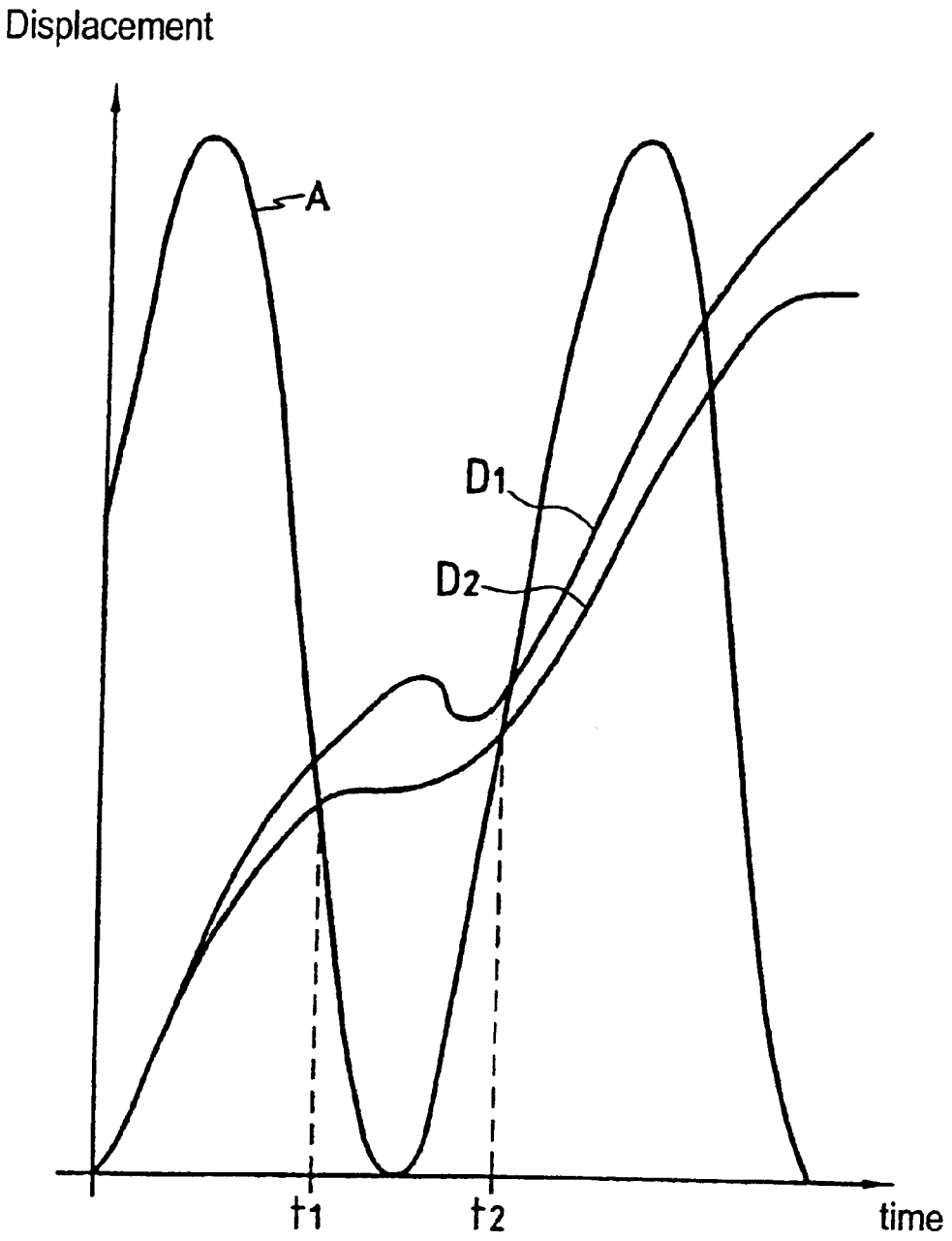
FIG. 5 is a graph illustrating the displacement of a fiber structure being needled in the FIG. 3 embodiment.

In FIG. 5, the curves represent displacement of the plate as a function of time, as measured firstly on the last layer on entering the needling zone (curve $D_1$), and secondly on leaving the needling zone (curve $D_2$), and curve A represents the displacement of the needles. The displacement at the inlet and at the outlet is measured by respective sensors providing signals representative of the distance the plate advances.

It can be seen that at the outlet, i.e. immediately downstream from the presser rollers driving the plate, plate advance diminishes shortly after instant $t_1$ at which the needles penetrate, and it begins to increase shortly after instant $t_2$ when the needles have been extracted completely from the plate.

At the inlet, in the needling zone, i.e. immediately upstream from the unclutched presser rollers, advance continues to increase after time $t_1$, before reversing. This can be explained by the ability of the sheet to deform elastically in the longitudinal direction combined with the fact that, in the embodiment concerned, no use is made of a stripper element of the type constituted by a presser foot holding the plate down during needle penetration. Consequently, when the needles rise, they tend to raise the plate slightly before it comes free and drops back onto the needling platen.

In a variant of the above described embodiment, the slowdown of the plate may be detected by measuring the torque at an end of the shaft of one or both presser roller(s) ensuring the driving of the plate. The lengthening of the belt portion between the motor and the driving roller as a consequence of the penetration of the needles results in a decrease of the measured torque evidencing the slowdown of the plate. It is then possible to control a reduction of the speed of the driving motor from an assigned value when the decrease of the measured torque reaches a given threshold, which adds to the effect of the resilient slack in the transmission to quickly react to the resistance to advance exerted by the needles. Upon withdrawal of the needles from the fiber structure, the shortening of the belt portion causes the driving presser rollers to accelerate. The speed of the motor may then be increased and returned to its assigned value as a response to the detection of an increase of the measured torque.

Obviously, the measure of torque is carried out alternatively on one pair of presser rollers and on the other pair, as a function of the direction of displacement of the plate.

In the above variant, the motor is controlled at a speed which is constant but adjustable.

An embodiment of the invention is described above for needling a plate that is moved in rectilinear translation through a needling station. Nevertheless, the person skilled in the art will see immediately that the invention is equally applicable to needling annular fiber structures formed by helically winding a fiber structure as flat superposed turns or for needling sleeve-shaped structures formed by rolling up a fabric of superposed turns, which structures are driven in rotation past a needling head. Under such circumstances, the advance motion of the fabric is one-dimensional.

Causing the speed of advance of the fiber structure to slow down directly by the resistance to advance caused by the needles with resilient slack being included in the transmission presents several advantages: it is self-adapting, in particular as the plies build up and as the thickness of the structure increases at the beginning of buildup, and it makes it possible to maintain a mean speed of advance that is relatively high since advance acceleration when the needles are not in the structure compensates for advance deceleration caused by the needles penetrating.

Nevertheless, the speed of advance of the fiber structure could be controlled as a function of the measure of a value representing the force exerted for moving the fiber structure.

Such a value is for example the torque which must be exerted for displacing the fiber structure. The torque may be measured at the level or a driving element, for example at the level of the driving motor.

Figure 6:
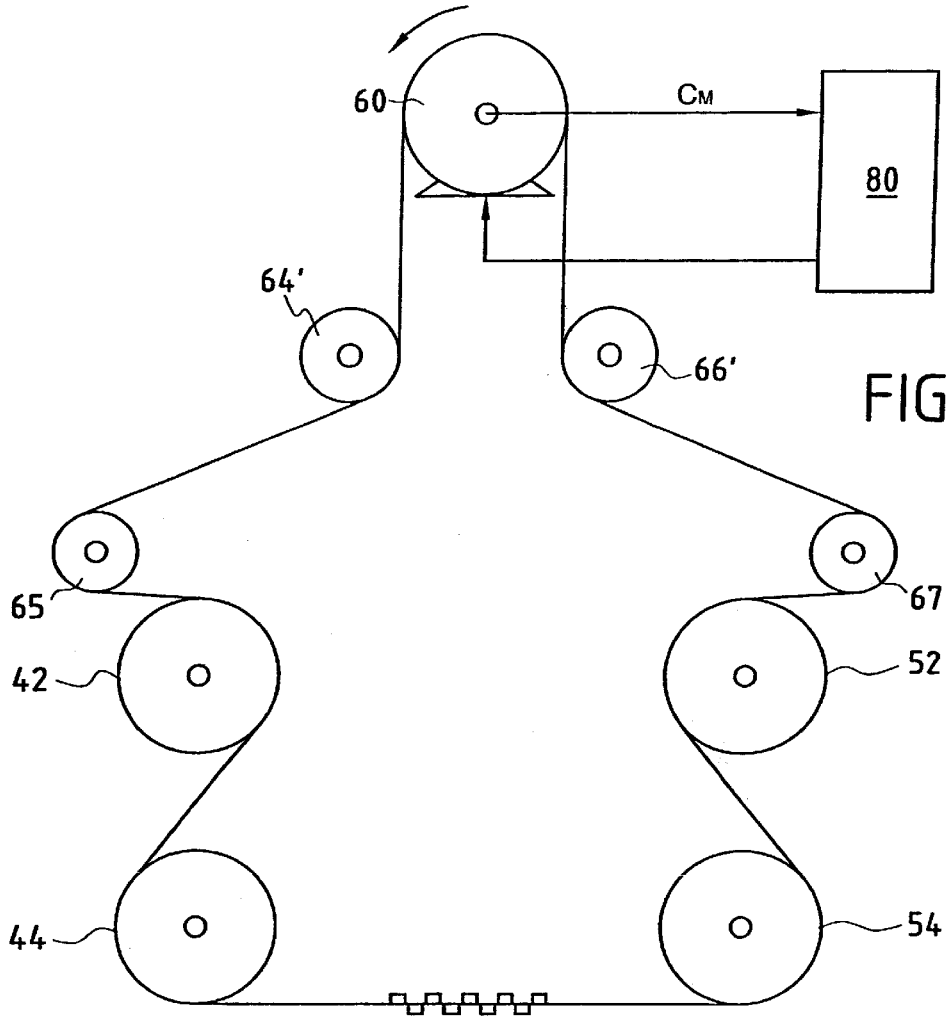
FIG. 6 is a highly diagrammatic view of a drive device for a fiber structure being needled, according to a second implementation of the invention.

FIG. 6 shows a drive device which differs from the one of FIG. 3 in that it does not include a resilient slack. The motor 60 drives the presser rollers 42–44 and 52–54 by means of belt 62 passing over deflector rollers 65, 67 and 64', 66', the latter having a fixed axis contrary to the rollers 64, 66 of FIG. 3.

A (non-represented) sensor provides a signal $S_C$ representative of the value of the torque $C_M$ exerted by the motor 60, for example by measuring current drawn by the motor. The motor may consist in a step-motor controlled by control circuit 80.

Figure 7:
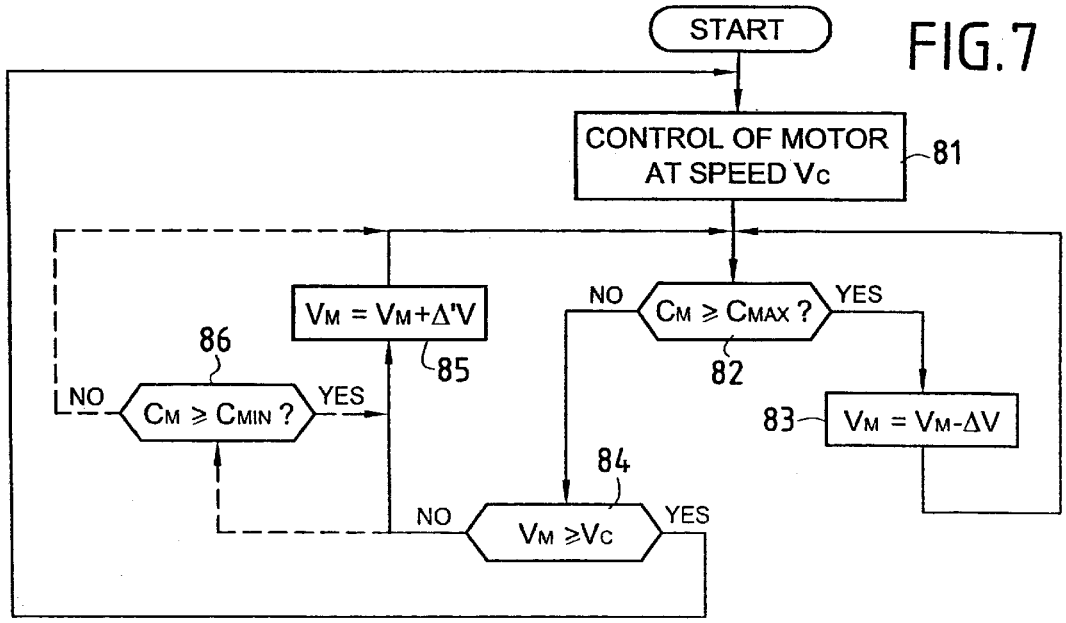
FIG. 7 is a chart showing the process of controlling the driving of the fiber structure in the second implementation of the invention.

As illustrated by FIG. 7, motor 60 is originally controlled at a predetermined assigned speed $V_C$ (step 81). If the measured torque becomes equal to or larger than a maximum threshold value $C_{max}$ (test 82), the speed of the motor is decreased by an increment $\Delta V$ (step 83) before returning to test 82.

If the measured torque $C_M$ is lower than $C_{max}$ (test 82), and if the motor speed $V_M$ is lower than the assigned value $V_C$ (test 84) the speed $V_M$ is increased by an increment $\Delta'V$ equal or not to $\Delta V$ (step 85). Otherwise, if the speed $V_M$ is equal to or larger than $V_C$, it is maintained unchanged or brought back to the value $V_C$ (return to step 81).

As a variant, as shown by interrupted lines on FIG. 7, when CM is equal to or lower than $C_{max}$ and $V_M<V_C$, it can be checked whether the torque $C_M$ has become lower than a threshold $C_{min}$ lower than $C_{max}$ (test 86). If yes, the speed $V_M$ is increased by an increment $\Delta'V$. Otherwise, it remains unchanged and the process returns to test 82.

When the needles penetrate into the fiber structure, the resistance to advance exerted by the needles causes an increase in the torque required to continue to drive the fiber structure at the assigned speed. The speed is reduced by an increment $\Delta V$ as soon as the torque reaches the threshold $C_{max}$. Several consecutive speed diminution increments may be necessary during penetration of the needles. Upon withdrawal of the needles, the speed is increased by one of several successive increments when the torque $C_M$ becomes lower than $C_{max}$ or $C_{min}$, until the assigned speed value is again reached.

In the embodiment of FIGS. 6 and 7, it is supposed that there is no sliding between the fiber texture and the driving presser rollers.

What is claimed is:

1. A method of needling a fiber structure in which a fiber structure for needling is driven so as to impart an advance movement thereto past a needling head carrying a plurality of needles driven with reciprocating motion during which they penetrate into the fiber structure and are extracted therefrom, wherein the instantaneous speed of advance of the fiber structure decreases in response to the resistance to advance exerted by the needles penetrating into the structure, and increases after the needles have been withdrawn, so that the force exerted on the needles by the advance of the structure is limited, but without completely interrupting advance throughout the entire duration of needles being present in the structure.

2. A method according to claim 1, wherein the decrease in the speed of advance is caused directly by the resistance to advance exerted by the needles on penetrating into the structure.

3. A method according to claim 2, wherein the fiber structure is caused to advance by means of a transmission that includes mechanical slack capable of absorbing the decrease in the speed of advance of the fiber structure.

4. A method according to claim 3, wherein the transmission is used presenting resilient slack and connected to a drive motor operating at constant speed so that the decrease in the speed of advance in response to needle penetration is compensated by an acceleration after the needles have been withdrawn.

5. A method according to claim 3, wherein a torque is measured at the level of a driving element in engagement with the fiber structure in order to decrease the speed of the motor when the torque measured becomes lower than a threshold.

6. A method according to claim 4, wherein a torque is measured at the level of a driving element in engagement with the fiber structure in order to decrease the speed of the motor when the torque measured becomes lower than a threshold.

7. A method according to claim 1, wherein a value representative of the force exerted to drive the fiber structure is measured, the driving speed of the fiber structure is decreased when the measured value becomes equal to or greater than a first threshold value, and, after the speed has been decreased, the speed is increased when the measured value becomes lower than a second threshold value.

8. A method according to claim 7, wherein the measured value is representative of the torque exerted by a driving element for the fiber structure.

9. An installation for needling a fiber structure, the installation comprising a needling head carrying a plurality of needles, a device for driving the needling head to impart reciprocating motion to the needles, a support for the fiber structure to be needled situated facing the needling head, and a device for driving the fiber structure so as to impart an advance movement thereto on said support, wherein the fiber structure drive device is designed to enable the speed of advance of the fiber structure carried by the support to decrease momentarily in response to the resistance to advance exerted by the needles penetrating into the fiber structure, without completely interrupting advance throughout the duration of the needles being present in the fiber structure.

10. An installation according to claim 9, wherein the fiber structure drive device comprises a constant speed drive motor and a transmission having slack between the drive motor and the fiber structure.

11. An installation according to claim 10, wherein the transmission has slack that is resilient.

12. An installation according to claim 11, wherein the transmission comprises a belt, at least one tensioning roller over which the belt passes, and means exerting a resilient return force on the tensioning roller.

13. An installation according to claim 12, wherein the means exerting a resilient return force are constituted by an adjustable-pressure pneumatic damper.

14. An installation according to claim 9, wherein the fiber structure drive device comprises at least one sensor for sensing the force exerted to drive the fiber structure, and a control circuit connected to said sensor and arranged to control the speed of the motor as a function of the measured force.

15. An installation according to claim 14, wherein said sensor is a torque sensor for sensing the torque delivered by a driving motor.

* * * * *

UNITED STATES PATENT AND TRADEMARK OFFICE

CERTIFICATE OF CORRECTION

PATENT NO. : 6,568,050 B2
DATED : May 27, 2003
INVENTOR(S) : Renaud Duval

It is certified that error appears in the above-identified patent and that said Letters Patent is hereby corrected as shown below:

Column 7,
Line 40, "CM" should read -- $C_m$ --.

Signed and Sealed this

Twenty-fourth Day of February, 2004

JON W. DUDAS
*Acting Director of the United States Patent and Trademark Office*